US006817615B1

(12) United States Patent
Dacey

(10) Patent No.: US 6,817,615 B1
(45) Date of Patent: Nov. 16, 2004

(54) MODIFIED POKER CARD GAME

(76) Inventor: Thomas M. Dacey, 17 Nelson Ave., Beverly, MA (US) 01915

( * ) Notice: Subject to any disclaimer, the term of this patent is extended or adjusted under 35 U.S.C. 154(b) by 0 days.

(21) Appl. No.: 10/658,621

(22) Filed: Sep. 9, 2003

(51) Int. Cl.[7] ..... A63F 1/00

(52) U.S. Cl. ..... 273/292; 273/274; 273/309; 463/13

(58) Field of Search ..... 273/292, 274, 273/309; 463/13

(56) References Cited

U.S. PATENT DOCUMENTS 5,067,724 A 11/1991 Rinkavage
5,486,005 A 1/1996 Neal
5,489,101 A * 2/1996 Moody ..... 273/292
5,531,448 A 7/1996 Moody
5,607,162 A * 3/1997 Boylan et al. ..... 273/292
5,657,993 A * 8/1997 Merlino et al. ..... 273/292
5,664,781 A 9/1997 Feola
5,722,661 A 3/1998 Skratulia et al.
5,810,354 A 9/1998 Banyai
6,131,907 A 10/2000 Nucifora et al.
6,450,883 B1 * 9/2002 O'Halloran ..... 463/16

* cited by examiner

*Primary Examiner*—Benjamin Layno
(74) *Attorney, Agent, or Firm*—Joseph R. Birkner

(57) ABSTRACT

A method for playing a poker card game is disclosed which relates to a modified poker card game utilizing playing cards arranged in a pyramid-like format from which, in addition to forming a winning hand from cards in the deck, as dealt, also utilizes the pyramid card arrangement from which a winning poker hand may be combined with the deck dealt cards.

20 Claims, 7 Drawing Sheets

MODIFIED POKER CARD GAME

FIELD OF THE INVENTION

This invention relates generally to poker card games. More particularly, the present invention relates to a novel method for playing a modified poker card game utilizing playing cards arranged in a pyramid-like format.

BACKGROUND OF THE INVENTION

Poker is a favorite card game which is played by many people. Typically, the game is played with a standard deck of 52 playing cards. The object of the game of poker is to obtain the best hand. A hand consists of five cards. The individual cards are ranked in the following order from highest to lowest: Ace, King, Queen, Jack, 10, 9, 8, 7, 6, 5, 4, 3, 2. The suits are clubs, diamonds, hearts and spades.

The hands are ranked in the following order from highest to lowest:

(1) Five Of A Kind—Five cards of equal rank.
(2) Royal Flush—Ace, King, Queen, Jack, 10—all of the same suit.
(3) Straight Flush—Five cards, all of the same suit, in sequence.
(4) Four Of A Kind—Four cards of equal rank.
(5) Full House—Three cards of equal rank and two cards of equal rank.
(6) Flush—Any five cards of the same suit.
(7) Straight—Five cards of mixed suits, in sequence.
(8) Three Of A Kind—Three cards of equal rank.
(9) Two Pair—Two cards of equal rank and a different two cards of equal rank.
(10) One Pair—Two cards of equal rank.
(11) High Card—The card that has the highest rank.

For example, hand (5), a Full House, is better than hands (6) through (11). However, hands (1) through (4), are each better than hand (5). The best hand among the players is declared. The player who has the best hand is the winner. If two or more players have the same best hand, the players are each declared the winner or the best hand with the highest ranking of individual card(s) is determined. The player who has this hand is then declared the winner.

For typical poker, a player is dealt cards or draws cards from the deck itself from which the winning hand is assembled. A problem with drawing from the deck itself is that the winning hand depends entirely upon the cards dealt directly from the deck which, after a while, become somewhat boring and unchallenging since a player can only win in one way; ie. obtaining the best hand from the hand of five cards as described above.

No modified poker card game is known which, in addition to forming a winning hand from cards in the deck, as dealt, also utilizes a pyramid card arrangement from which a winning poker hand may be combined with the deck dealt cards.

In view of the above mentioned problems and limitations associated with playing standard poker card games, it was recognized by the present inventor that there is an unfulfilled need for an improved method for playing a modified version of poker and one which is simple, practical, fun to play and is easily played using a standard deck of cards and a pyramid arrangement of cards.

Accordingly, it becomes clear that there is a great need for a method for playing a modified pyramid poker card game which overcomes the disadvantages associated with standard poker card games. Such a modified poker card game should be one that is easy and fun to play and one which differs from conventional poker card game methods of play.

SUMMARY OF THE INVENTION

It is therefore an object of this invention to provide a modified poker card game for playing poker which avoids the aforementioned conventional poker card game problems and limitations associated therewith.

It is an object of this invention to provide a method for playing a modified poker card game which utilizes cards arranged in a pyramid.

It is another object of this invention to provide a method of playing a modified poker card game which, in addition to forming a winning hand from cards in the deck, as dealt, also utilizes a pyramid card arrangement from which a winning poker hand may be combined with the deck dealt cards.

It is another object of this invention to get rid of three cards in the hand of a player.

It is another object of this invention to provide a method for playing a modified version of poker which is simple, practical, fun to play and is easily played using a standard deck of cards and a pyramid arrangement of cards.

Further objects will become apparent from the following description and claims.

This invention results from the realization that there is a great need for a new method for playing poker without the problems associated with playing traditional poker. The resulting invention provides a player the capability of being able to play a more challenging poker card game whereby, a winning poker hand is formed in combination with dealt cards from cards in the deck and from the cards arranged in the pyramid.

The above and the other objects are achieved in accordance with the present invention, which, according to a first aspect, provides a method for playing a modified poker card game using a standard deck of playing cards comprising the steps of (a) dealing four cards, face down, to a player defining a hand; (b) discarding one card from the hand of the player, leaving the player with three cards; (c) dealing six cards, face down from the deck, arranged in a community defining a pyramid having a top row with one wild card, a middle row with two discards and a bottom row with three play cards; (d) comparing matching cards, by rank, from the hand of each player and from the play cards and the wild card, with the discards and placing them on top of the matching discards when the play cards, the discards and the wild card are turned face up during the course of play, (e) forming, by each player, a best poker hand, wherein the best poker hand consisting of a maximum of five cards chosen from the cards remaining in the hand of the player and from the play cards remaining and from the wild card, if it remains, of the pyramid; wherein the wild card and any card having the same rank as the wild card may represent any card including the discards and any matching cards that have been placed on top of the matching discards during the course of play; (f) exposing the best poker hand, by each player, face up; (g) examining the best poker hand among the players; and (h) declaring the player having the best poker hand, as the winner.

A second aspect is a special case of the first aspect of this invention with additional features. According to a second aspect of the invention, the first aspect further comprising the step of allowing each player to place a bet, in turn, in a pot, after each play card, each discard and wild card of the pyramid is turned face up. Each player may select a standard traditional poker betting option and rule instead of placing a bet in a pot after each play card, each discard and wild card of the pyramid is turned face up.

BRIEF DESCRIPTION OF THE DRAWINGS

In the accompanying drawings:

FIG. 1 is a perspective view of a playing surface showing the arrangement of a modified pyramid poker game, including a pyramid, with all cards face down at the start of a card game.

FIG. 2 is a plan view of the pyramid of FIG. 1 showing a first play card in the bottom row of the pyramid turned face up to begin the card game.

FIG. 3 is a plan view of the pyramid of FIG. 2 showing a first discard in the middle row of the pyramid turned face up.

FIG. 4 is a plan view of the pyramid of FIG. 3 showing a second play card in the bottom row of the pyramid turned face up.

FIG. 5 is a plan view of the pyramid of FIG. 4 showing a second discard in the middle row of the pyramid turned face up.

FIG. 6 is a plan view of the pyramid of FIG. 5 showing a third play card in the bottom row of the pyramid turned face up.

FIG. 7 is a plan view of the pyramid of FIG. 6 showing a wild card in the top row of the pyramid turned face up with all cards in the pyramid being turned face up.

FIG. 8 is a plan view of the pyramid of FIG. 1 showing a card game hand with all cards in the pyramid turned face up including a matching card from a second player hand and from a fourth player hand, respectively placed on top of a first discard and on top of a second discard.

FIG. 9 is a plan view of the pyramid of FIG. 1 showing a card game hand with all cards in the pyramid turned face up including a matching second play card placed on top of a second discard.

FIG. 10 is a plan view of the pyramid of FIG. 1 showing a card game hand with all cards in the pyramid turned face up including a matching wild card placed on top of a first discard.

FIG. 11 is a plan view of the pyramid of FIG. 1 showing a card game hand with all cards in the pyramid turned face up including a matching card from a second player hand and from a third player hand, respectively placed on top of a first discard and on top of a second discard and a matching second play card placed on top of the third player card.

FIG. 12 is a plan view of the pyramid of FIG. 1 showing a card game hand with all cards in the pyramid turned face up including a matching card from a second player hand and from a third player hand, respectively placed on top of a first discard and on top of a second discard and a matching wild card placed on top of the third player card.

FIG. 13 is a plan view of the pyramid of FIG. 1 showing a card game hand with all cards in the pyramid turned face up including a matching second play card placed on top of a first discard and a matching wild card placed on top of the a second discard.

DETAILED DESCRIPTION OF ILLUSTRATIVE EMBODIMENTS

Figure 1:
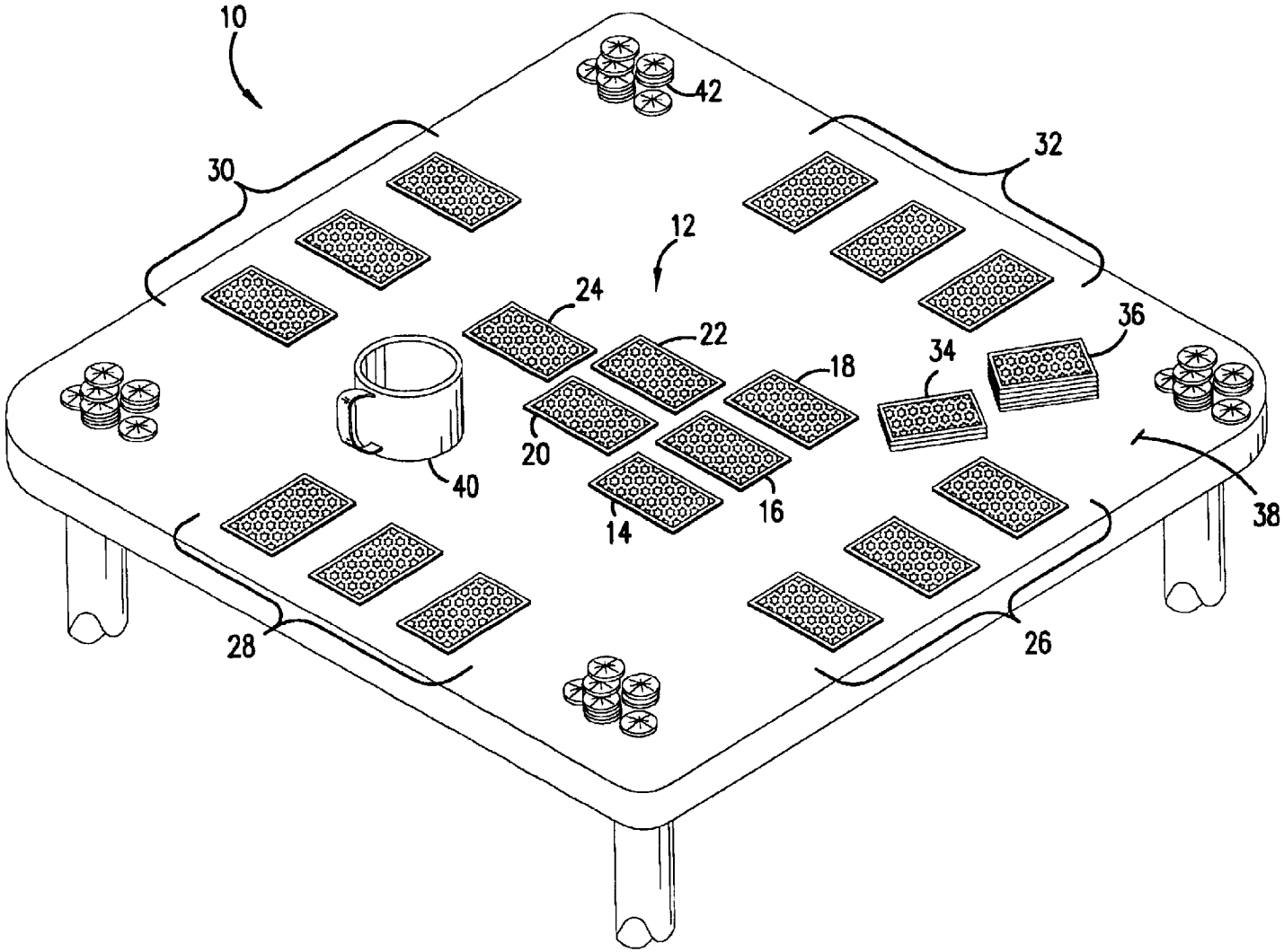
FIGS. 1 to 7 illustrate the sequence of play with four players.

Looking more particularly at the drawings, there is shown in FIG. 1 a first illustrative embodiment of a modified poker game which is generally indicated at 10, according to an embodiment of the present invention.

FIG. 1 is a perspective view of a playing surface 38 showing the arrangement of the modified pyramid poker game 10 with four players with all cards face down at the start of a card game. It is understood that the number of players can vary and the number of players who can play is determined by the quantity of cards available to arrange the cards as shown in FIG. 1.

The arrangement of FIG. 1 is accomplished as follows. A dealer deals four cards face down from a standard deck of 52 cards as indicated by 36, to each player, defining a hand. Each player discards one card from their hand, setting it aside and placing it in a removed hand card pile 34 leaving each player with a hand of three cards as indicated, respectively as a first player hand 26, a second player hand 28, a third player hand 30 and a fourth player hand 32.

The dealer deals six cards from the deck 36 face down arranged in a community defining a pyramid 12 having a top row with one wild card 24 that can be used by all players, a middle row with two discards, 20 and 22 and a bottom row with three play cards 14, 16 and 18 on the playing surface 38 which may be a table, a computer screen, a video screen or any suitable surface. It is pointed out that the forming of the pyramid 12 and the dealing of the four cards to each player may be done simultaneously or in any order. Preferably, the modified pyramid poker game 10 is played by placing a bet 42 into a pot 40 each of which may be placed on or in the vicinity of the playing surface 38. It is understood that the modified pyramid poker game 10 may also be played for fun, without betting, without departing from this disclosure.

There are at least two ways that a player can win by playing the modified poker card game 10. The first way is by forming a winning hand from cards as dealt, and from the pyramid 12 community card arrangement from which a winning poker hand may be combined with the deck. dealt cards from each player including the first player hand 26, the second player hand 28, the third player hand 30 and the fourth player hand 32. The second way a player may win is by getting rid of the three cards in his or her hand. Other variations to win may be possible.

When the modified poker game 10 is played with betting, the standard traditional poker betting options and rules may be followed. For example: A check allows a player to stay in a game without placing any bets. Note that a player can only check if no other bets have been placed in a given betting round. A call occurs when a player places a bet to match what has been bet since the last time he or she bet. The player would put the amount that he or she owes into the pot 40. This allows the player to stay in the game. A raise occurs when a player first puts enough into the pot 40 to match what has already been bet and then the player puts an additional amount into the pot 40. A fold occurs when a player drops out of the current hand and therefore loses the possibility of winning the pot 40. For the rest of the current hand, the player does not put any amount into the pot 40.

Referring to FIGS. 1 to 13, the modified poker card game 10 is played beginning with the cards turned face down and arranged as shown in FIG. 1.

FIGS. 2 to 7 illustrate the sequence in which each card in the pyramid 12 is turned face up during play.

Figure 2:
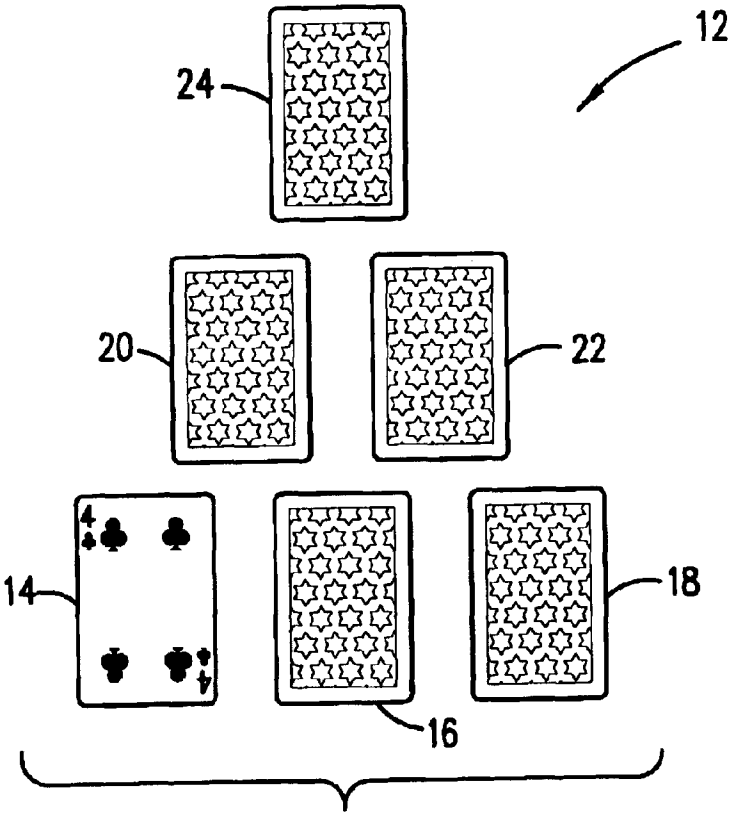

As shown in FIG. 2, a first play card 14 in the bottom row of the pyramid 12 is turned face up. The first player makes a check or a bet 42 based on the first player hand 26 seen in FIG. 1, including the first play card 14. The next players choose one of the above described betting options considering their own player hand and the first play card 14.

Figure 3:
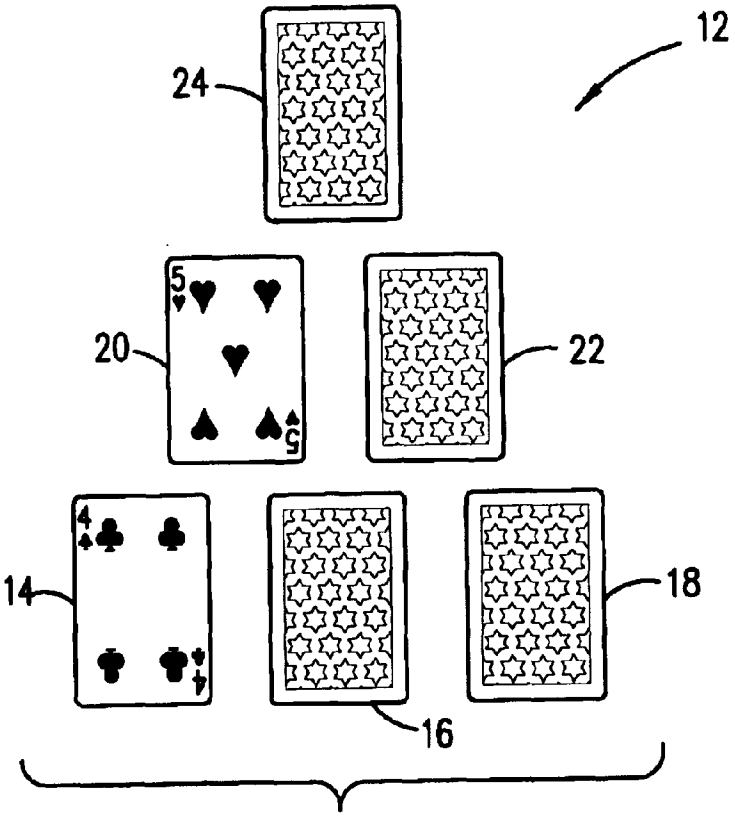

As shown in FIG. 3, a first discard 20 in the middle row of the pyramid 12 is turned face up.

Each player holding a card (cards) in his or her hand; ie. a first player hand 26, a second player hand 28, a third player hand 30 and a fourth player hand 32, that matches (match), by rank, the first discard 20 must remove the card (cards) out of their hand and place it (them) on top of the first discard 20. In this case, no matching cards were present.

Each player that has no more cards left in their hand will split the contents of the pot 40 with the winner. In this case, each player did not surrender any cards and still had three cards in his or her hand.

If the first play card 14 matches, by rank, the first discard 20, the first play card 14 must be placed on top of the first discard 20. In this case, no matching cards were present.

The next players choose one of the above described betting options considering their own player hand and the cards in the pyramid 12 that are turned face up.

Figure 4:
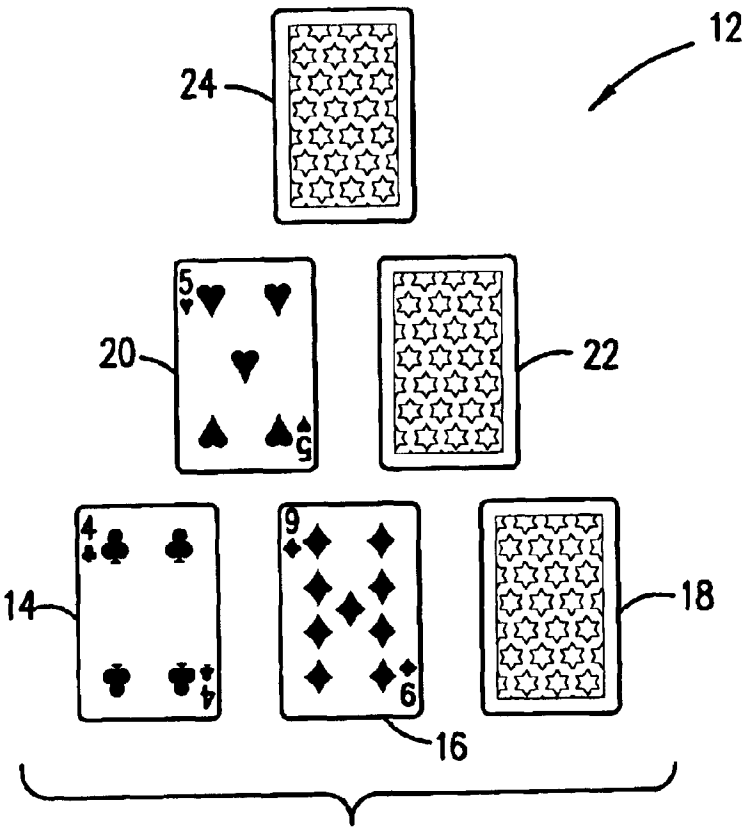

As shown in FIG. 4, a second play card 16 in the bottom row of the pyramid 12 is turned face up. If the second play card 16 matches, by rank, the first discard 20, the second play card 16 must be placed on top of the first discard 20. In this case, no matching cards were present.

The next players choose one of the above described betting options considering their own player hand and the cards in the pyramid 12 that are turned face up.

Figure 5:
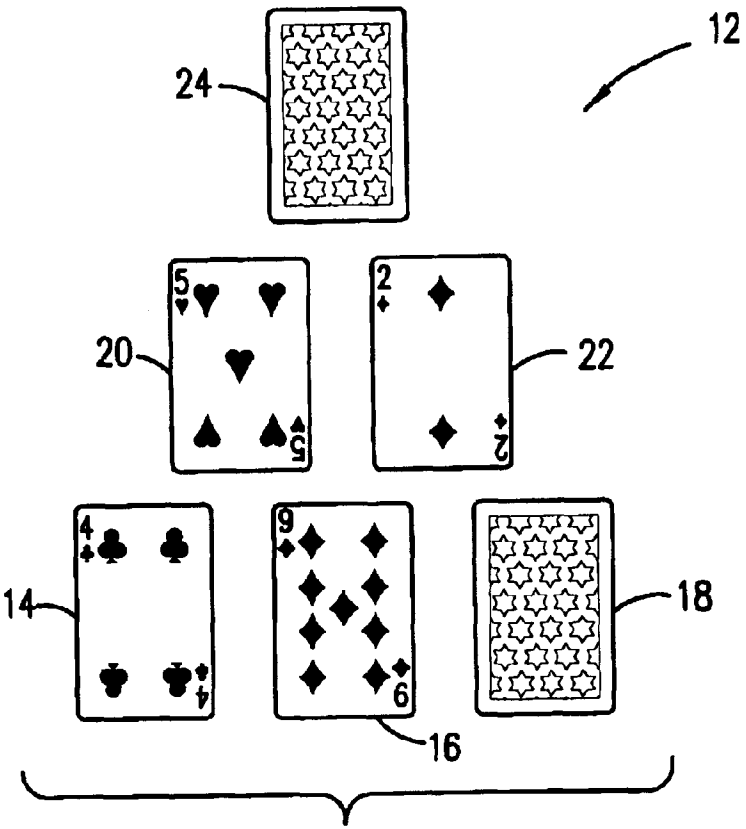

As shown in FIG. 5, a second discard 22 in the middle row of the pyramid 12 is turned face up.

Each player that holds a card (cards) in his or her hand that matches (match), by rank, the second discard 22 must remove the card (cards) out of their hand and place it (them) on top of the second discard 22. In this case, no matching cards were present.

Each player that has no more cards in his or her hand will split the contents of the pot 40 with the winner.

Any play card (cards) that matches (match), by rank, the second discard 22 must be placed on top of the second discard 22.

The next players choose one of the above described betting options considering their own player hand and the cards in the pyramid 12 that are turned face up.

Figure 6:
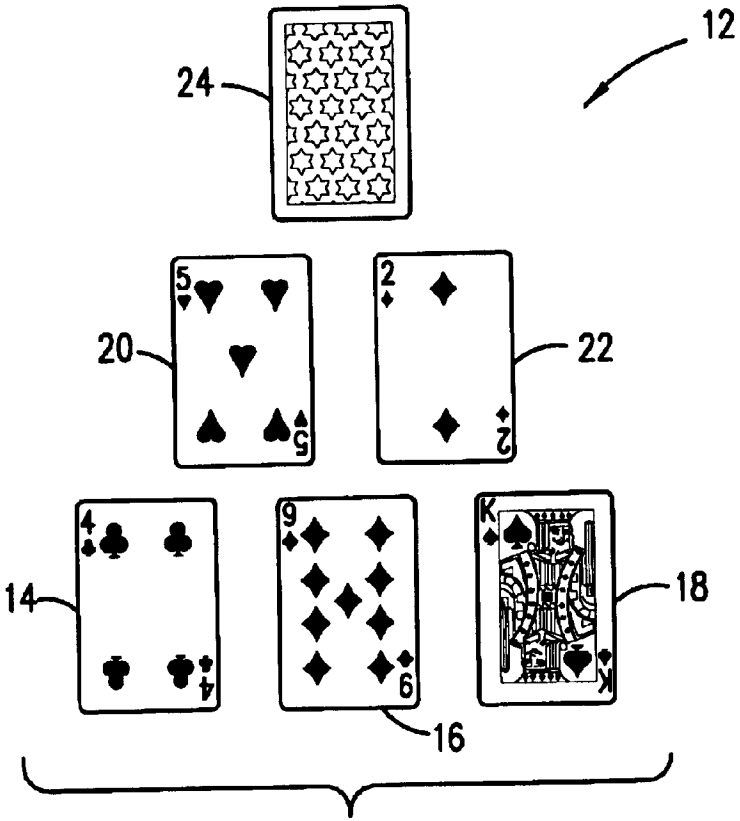

As shown in FIG. 6, a third play card 18 in the bottom row of the pyramid 12 is turned face up. If the third play card 18 matches, by rank, either the first discard 20 or the second discard 22, the third play card 18 must be placed on top of the first discard 20 or the second discard 22, that it matches. In this case, no matching cards were present.

The next players choose one of the above described betting options considering their own player hand and the cards in the pyramid 12 that are turned face up.

Figure 7:
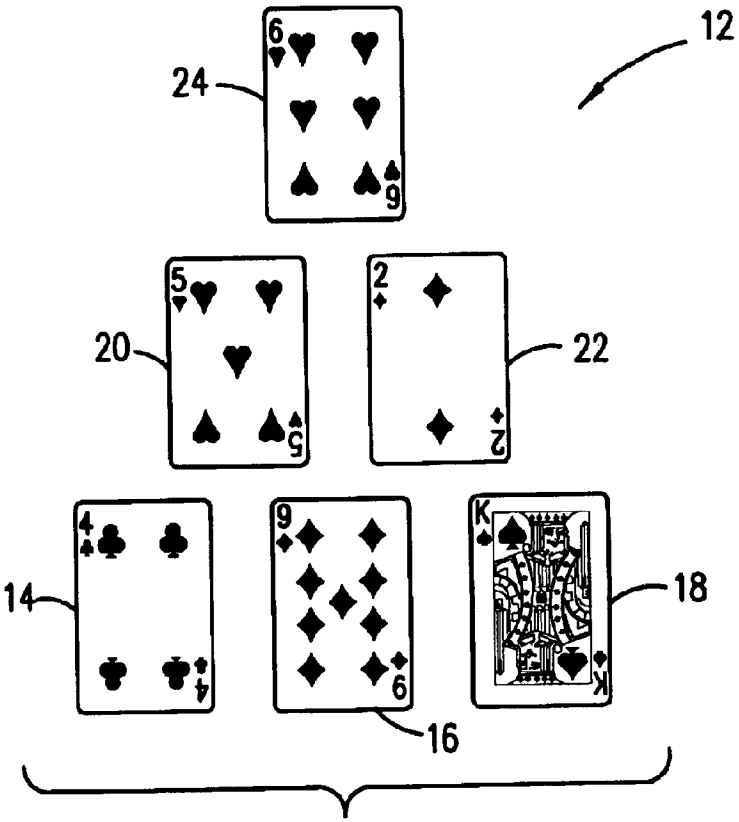

As shown in FIG. 7, a wild card 24 in the top row of the pyramid 12 is turned face up.

If the wild card 24 matches, by rank, either the first discard 20 or the second discard 22, the wild card 24 must be placed on top of the first discard 20 or the second discard 22, that it matches. In this case, no matching cards were present.

The next players choose one of the above described betting options considering their own player hand and the cards in the pyramid 12.

Each player remaining in the game forms the best poker hand that he or she possibly can.

The best poker hand consists of a maximum of five cards chosen from the cards remaining in the hand of the player and from the play cards remaining and from the wild card, if it remains, of the pyramid 12. The wild card and any card having the same rank as the wild card may represent any card including the discards and any matching cards that have been placed on top of matching the discards during the course of play. In this case the wild card 24 was available to all players and all players had three cards in the first play band 26, the second play hand 28, the third play hand 30 and the fourth play hand 32 and the play cards 14, 16 and 18 were available from which the best poker hand could be formed.

Each player remaining in the game places the card (cards) that remains (remain) in his or her hand face up on the playing surface 38.

The best poker hand among the players is declared and the player who has the best poker hand is the winner and may claim the full contents of the pot 40.

Each player having no cards in their hand or having a player hand identical to the winner shares the pot 40 with the winner.

It is understood that each player is allowed to select a standard traditional poker betting option instead of placing a bet 42 in the pot 40 after each play card, each discard and the wild card of said pyramid 12 is turned face up.

The step of dealing six cards for defining the pyramid 12 may be completed prior to the step of dealing four cards to a player.

The step of dealing four cards to a player and the step of dealing six cards for defining the pyramid 12 may be performed simultaneously.

The step of discarding one card from the hand of a player, leaving a player with three cards may be completed after the step of dealing six cards for defining the pyramid 12.

During the course of play, the step of comparing matching cards, by rank, from the hand of each player and from the play cards and the wild card, with the discards and placing them on top of the matching discards includes turning the first play card 14 face up; turning the first discard 20 face up; turning the second play card 16 face up; turning the second discard 22 face up; turning the third play card 18 face up and turning the wild card 24 face up.

It is understood that the order of turning the play cards and the discards face up may be any order as long as the sequence of play of turning over cards in the pyramid 12 is followed, namely, one of the first play card 14, the second play card 16 and the third play card 18 followed by one of the first discard 20 and the second discard 22 and followed by the wild card 24 which is turned face up after all of the play cards and all of the discards have been turned face up.

The number of players is determined by the quantity of cards available from the deck 36 to deal four cards to each player and to form the pyramid 12 of six cards.

With the modified poker card game 10 being played as described above, it is understood that there are many possible combinations, permutations and outcomes from a given game. FIGS. 8 to 13 illustrate the various outcomes of different card game hands that can evolve during the course of play which are essentially permutations of FIG. 7.

Figure 8:
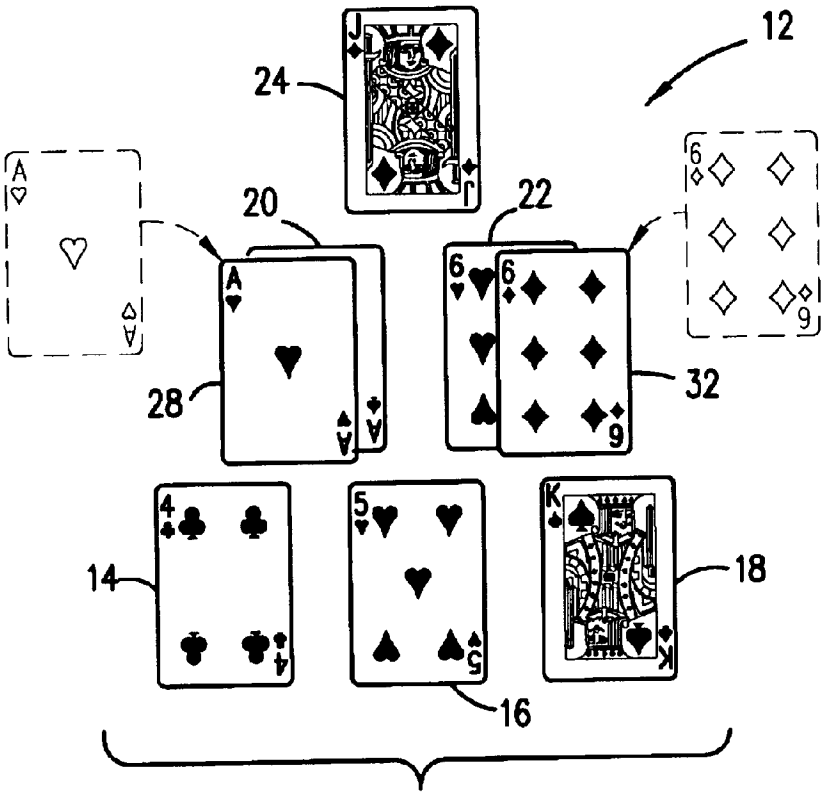

FIG. 8 is a second illustrative embodiment of the modified poker game 10 of FIG. 1, with a second hand of cards illustrated in the pyramid 12. In this situation, during the course of play, the second player had a second player hand 28 with a matching card being an ace of hearts which he had to place on top of the first discard 20 being an ace of spades and the fourth player had a fourth player hand 32 with a matching card being a six of diamonds which she had to place on top of the second discard 22 being a six of hearts thereby leaving both players with only two cards from which to combine with the play cards 14, 16 and 18 and the wild card 24 to make a best poker hand therefrom.

Figure 9:
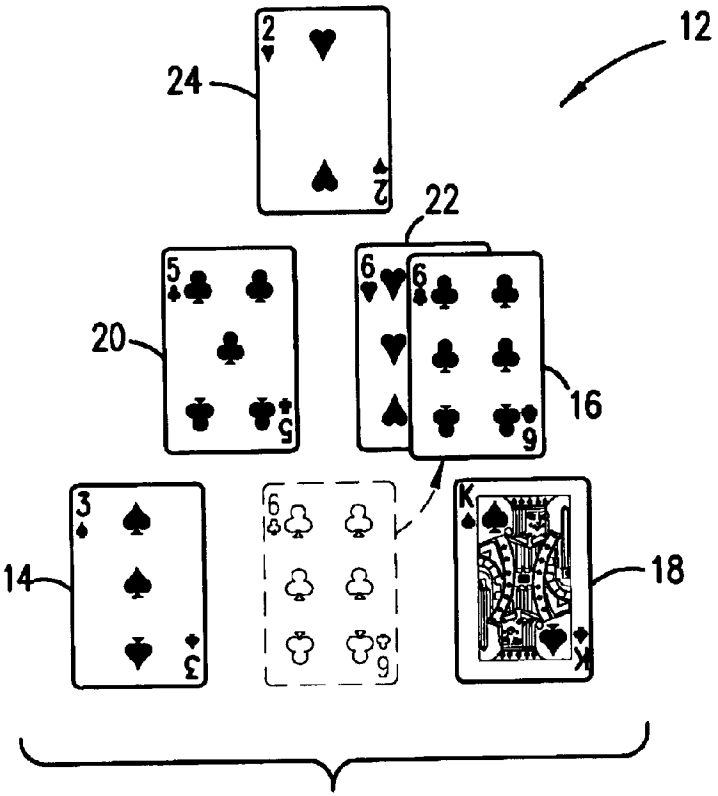
FIGS. 8 to 13 illustrate the various outcomes of different card game hands that can evolve during the course of play.

FIG. 9 is a third illustrative embodiment of the modified poker game 10 of FIG. 1, with a third hand of cards illustrated in the pyramid 12. In this situation, during the course of play, the second play card 16 in the bottom row of the pyramid 12 being a six of clubs matched the second discard 22 being a six of hearts which had to be placed on top of the second discard 22 thereby leaving all players with three cards from which to combine with the play cards 14 and 18 and the wild card 24 to make a best poker hand therefrom.

Figure 10:
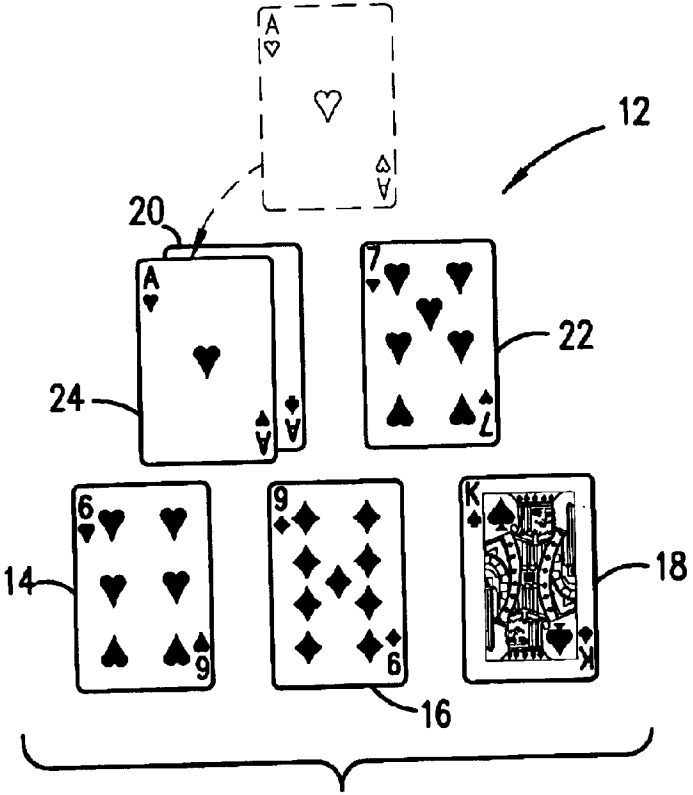

FIG. 10 is a fourth illustrative embodiment of the modified poker game 10 of FIG. 1, with a fourth hand of cards illustrated in the pyramid 12. In this situation, during the course of play, the wild card 24 in the top row of the pyramid 12 being an ace of hearts matched the first discard 20 being an ace of spades which had to be placed on top of the first discard 20 thereby leaving all players with three cards from which to combine with the play cards 14, 16 and 18 to make a best poker hand therefrom. The wild card 24, in this case, was unavailable.

Figure 11:
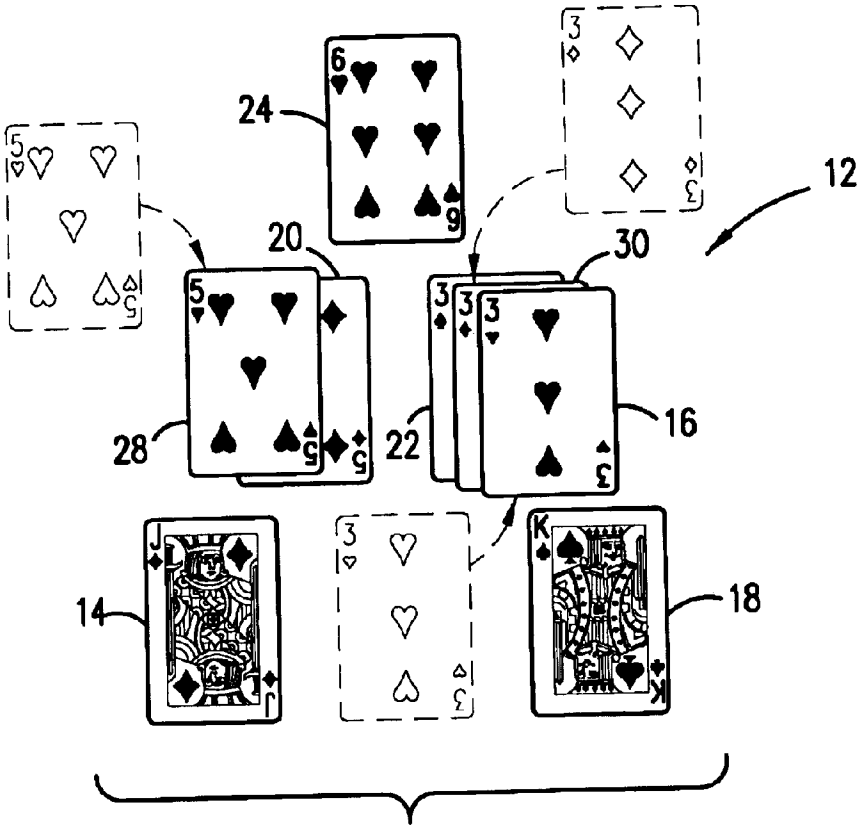

FIG. 11 is a fifth illustrative embodiment of the modified poker game 10 of FIG. 1, with a fifth hand of cards illustrated in the pyramid 12. In this situation, during the course of play, the second player had a second player hand 28 with a matching card being a five of hearts which he had place on top of the first discard 20 being a five of diamonds and the third player had a third player hand 30 with a matching card being a three of diamonds which she had to place on top of the second discard d 22 being a three of spades and the second play card 16 from the bottom row being a three of hearts had to be placed on top of the third player hand 30 and on top of the second discard 22 thereby leaving both players with only two cards from which to combine with the play cards 14 and 18 and the wild card 24 to make a best poker hand therefrom.

Figure 12:
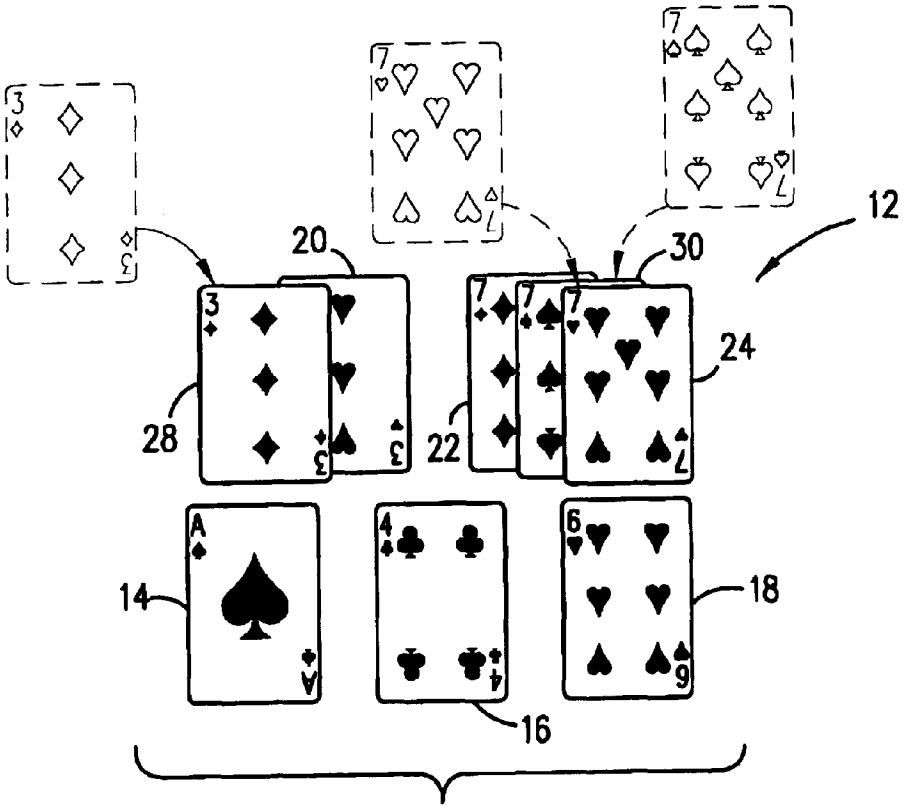

FIG. 12 is a sixth illustrative embodiment of the modified poker game 10 of FIG. 1, with a sixth hand of cards illustrated in the pyramid 12. In this situation, during the course of play, the second player had a second player hand 28 with a matching card being a three of diamonds which he had to place on top of the first discard 20 being a three of hearts and the third player had a third player hand 30 with a matching card being a seven of spades which she had to place on top of the second discard 22 being a seven of diamonds and the wild card 24 from the top row being a seven of hearts had to be placed on top of the third player hand 30 and on top of the second discard 22 thereby leaving both players with only two cards from which to combine with the play cards 14, 16 and 18 to make a best poker hand therefrom. The wild card 24, in this case, was unavailable.

Figure 13:
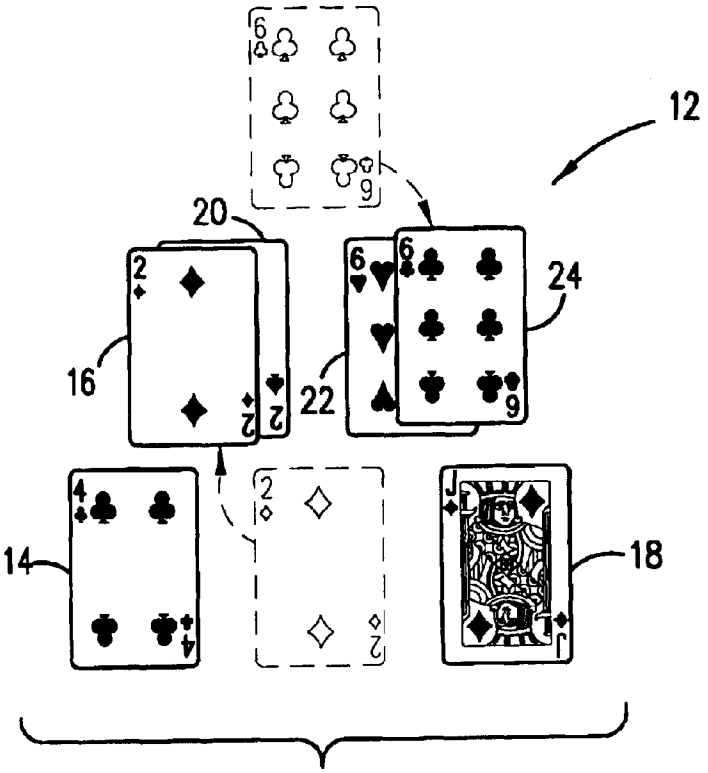

FIG. 13 is a seventh illustrative embodiment of the modified poker game 10 of FIG. 1, with a seventh hand of cards illustrated in the pyramid 12. In this situation, during the course of play, the second play card 16 from the bottom row being a two of diamonds had to be placed on top of the matching discard 20 being a two of spades and the wild card 24 from the top row being a six of clubs had to be placed on top of the second discard 22 being a six of hearts thereby leaving all players with three cards from which to combine with the play cards 14 and 18 to make a best poker hand therefrom. The wild card 24, in this case, was unavailable.

It is understood that the order in which the play cards in the bottom row of the pyramid 12 are turned up may be any order such as the first play card 14 turned up first or the second play card 16 turned up first or the third play card 18 turned up first as long as the above sequence of play of turning over cards in the pyramid 12 is followed, namely one of a play card 14, 16, and 18 followed by one of a discard 20 and 22 and a wild card 24. The wild card 24 is not turned over until all of the play cards and all of the discards have been turned over.

The inventor actually reduced the invention to practice and has played the modified poker card game 10 with favorable results.

Surprisingly, the instant invention provides an added advantage and recognizes a problem and adequately and completely addresses an unfulfilled need, in that the modified poker card game 10, in the manner disclosed, in effect, provides a convenient method for playing poker which eliminates the need to rely on getting a winning hand from the deck alone and one which provides the desired above mentioned advantages and benefits to a poker player.

It is understood that the modified poker card game 10 may be played in a wide variety of variations. For example, the modified poker card game 10 may be played electronically where the playing surface 38 is a computer screen and the cards are dealt via a random generator. One practical advantage of the invention is that it provides a challenging, practical, novel way to play poker. Another advantage of the invention is that it can be played with a standard deck of cards and without using any specially designed game board.

Of course, a wide variety of further uses and advantages of the present invention will become apparent to one skilled in the art.

As disclosed, it is apparent that the instant invention can provide other options. One skilled in the art will realize that the foregoing discussion outlines the more important features of the invention to enable a better understanding of the instant invention and to instill a better appreciation of the inventor's contribution to the art. It must be clear that the disclosed details of method of play, descriptions of layout and geometry and card arrangement and illustrations of inventive concepts and methodology are mere examples of possible manifestations of the invention.

Although the invention has been shown and described with reference to certain illustrative embodiments, those skilled in the art undoubtedly will find alternative embodiments obvious after reading this disclosure. With this in mind, the following claims are intended to define the scope of protection to be afforded the inventor, and those claims shall be deemed to include equivalent construction insofar as they do not depart from the spirit and scope of the present invention.

What is claimed is:

1. A method of playing a modified poker card game using a standard deck of playing cards comprising the steps:

(a) dealing four cards, face down, to a player defining a hand;

(b) discarding one card from the hand of the player, leaving the player with three cards;

(c) dealing six cards, face down from the deck, arranged in a community defining a pyramid having a top row with one wild card, a middle row with two discards and a bottom row with three play cards, (d) comparing matching cards, by rank, from the hand of each player and from said play cards and said wild card, with said discards and placing them on top of matching said discards, when said play cards, said discards and said wild card are turned face up during the course of play;

(e) forming, by each player, a best poker hand, wherein the best poker hand consisting of a maximum of five cards chosen from the cards remaining in the hand of the player and from said play cards remaining and from said wild card, if it remains, of said pyramid; wherein said wild card and any said card having the same rank as said wild card may represent any card including said discards and any said matching cards that have been placed on top of matching said discards during the course of play;

(f) exposing the best poker hand, by each said player, face up;

(g) examining the best poker hand among the players; and (h) declaring the player having the best poker hand, as the winner.

2. The method of claim 1 further comprising the step of allowing each said player to place a bet, in a pot, after each said play card, each said discard and said wild card of said pyramid is turned face up.

3. The method of claim 2 further comprising the step of claiming, by the winner, the full contents of said pot.

4. The method of claim 2 further comprising the step of sharing said pot, by the winner, with each said player having no said cards in said hand.

5. The method of claim 2 further comprising the step of sharing said pot, by the winner, with each said player having a player hand identical to the winner.

6. The method of claim 1 further comprising the step of allowing each said player to select a standard traditional poker betting option instead of placing a bet in a pot after each said play card, each said discard and said wild card of said pyramid is turned face up.

7. The method of claim 1 wherein said step (c) of dealing said six cards for defining said pyramid is completed prior to said step (a) of dealing said four cards to said player.

8. The method of claim 1 wherein said step (a) of dealing said four cards to said player and said step (c) of dealing said six cards for defining said pyramid are performed simultaneously.

9. The method of claim 1 wherein said step (b) of discarding one said card from said hand of said player, leaving said player with three said cards is completed after said step (c) of dealing said six cards for defining said pyramid.

10. The method of claim 1 wherein the course of play of said step (d) includes turning a first play card face up; turning a first discard face up; turning a second play card face up; turning a second discard face up; turning a third play card face up and turning said wild card face up.

11. The method of claim 10 wherein the order of turning said play cards and said discards face up may be any order as long as the sequence of play of turning over cards in said pyramid is followed, namely, one of said first play card, said second play card and said third play card followed by one of said first discard and said second discard and followed by said wild card which is turned face up after all of said play cards and all of said discards have been turned face up.

12. The method of claim 1 wherein the number of said players is determined by the quantity of said cards available from the deck to deal four said cards to each said player and to form said pyramid of said six cards.

13. A method of playing a modified poker card game using a standard deck of playing cards comprising the steps:

(a) dealing four cards, face down, to a player defining a hand;

(b) discarding one said card from said hand of said player, leaving said player with three said cards;

(c) dealing six cards, face down from the deck, arranged in a community defining a pyramid having a top row with one wild card, a middle row with two discards and a bottom row with three play cards;

(d) allowing each said player to selectively place a bet, in turn, in a pot after each said play card, said discard and said wild card of said pyramid is turned face up;

(e) comparing matching cards by rank from the hand of each player and from said play cards and said wild card, with said discards and placing them on top of matching said discards when said play cards, said discards and said wild card are turned face up during the course of play; wherein the course of play includes turning a first play card face up; turning a first discard face up; turning a second play card face up; turning a second discard face up; turning a third play card face up and turning said wild card face up;

(f) forming, by each player, a best poker hand, wherein the best poker hand consisting of a maximum of five cards chosen from the cards remaining in the hand of the player and from said play cards remaining and from said wild card, if it remains, of said pyramid; wherein said wild card and any said card having the same rank as said wild card may represent any card including said discards and any said matching cards that have been placed on top of matching said discards, during the course of play;

(g) exposing the best poker hand, by each said player, face up;

(h) examining the best poker hand among said players; and (i) declaring said player having the best poker hand, as the winner.

14. The method of claim 13 further comprising the step of claiming, by the winner, the full contents of said pot.

15. The method of claim 13 further comprising the step of sharing said pot, by the winner, with each said player having no said cards in said hand and with each said player having a player hand identical to the winner.

16. The method of claim 13 further comprising the step of allowing each said player to select a standard traditional poker betting option instead of placing a bet in a pot after each said play card, each said discard and said wild card of said pyramid is turned face up.

17. The method of claim 13 wherein the order of turning said play cards and said discards face up may be any order as long as the sequence of play of turning over cards in said pyramid is followed, namely, one of said first play card, said second play card and said third play card followed by one of said first discard and said second discard and followed by said wild card which is turned face up after all of said play cards and all of said discards have been turned face up.

18. A method of playing a modified poker card game comprising the steps:

(a) providing a deck of standard fifty two cards; (b) dealing four cards from the deck, face down, to at least two players defining a hand; (c) discarding one card from said hand of each said player, leaving each said player with three cards; (d) dealing six cards, face down from the deck, arranged in a community defining a pyramid having a top row with one wild card, a middle row with two discards and a bottom row with three play cards; (e) allowing each said player to select one of placing a bet in a pot after each said play card, each said discard and said wild card of said pyramid is turned face up and a standard traditional poker betting option instead of placing said bet; (f) turning a first play card face up; (g) turning a first discard face up; (h) comparing each said card held in said hand by each said player with said first discard for a match, by rank; (i) removing matching said card from each said player's said hand and placing it on top of said first discard; (j) comparing said first play card with said first discard for a match, by rank; (k) removing matching said first play card and placing it on top of said first discard, (l) turning a second play card face up; (m) comparing said second play card with said first discard for a match, by rank; (n) removing matching said second play card and placing it on top of said first discard; (o) turning a second discard face up; (p) comparing each said card held in said hand by each said player with said second discard for a match, by rank; (q) removing matching said card from each said player's said hand and placing it on top of said second discard; (r) comparing said first play card and said second play card with said second discard for a match, by rank; (s) removing matching said first play card and matching said second play card and placing them on top of said second discard; (t) turning a third play card face up; (u) comparing said third play card with said first discard and with said second discard for a match, by rank; (v) removing matching said third play card and placing it on top of one of said first discard and said second discard that it matches; (w) turning said wild card face up; (x) comparing said wild card with said first discard and with said second discard for a match, by rank; (y) placing said wild card on top of one of said first discard and said second discard that it matches; (z) forming, by each player, a best poker hand, wherein the best poker hand consisting of a maximum of five cards chosen from the cards remaining in the hand of the player and from said play cards remaining and from said wild card, if it remains, of said pyramid; wherein said wild card and any said card having the same rank as said wild card may represent any card including said discards and any said matching cards that have been placed on top of matching said discards during the course of play; (z1) exposing the best poker hand, by each said player, face up; (z2) examining the best poker hand among said players; and (z3) declaring said player having the best poker hand, as the winner, whereby the winner claiming the full contents of said pot and the winner sharing said pot with each said player having no said cards in said hand and with each said player having a player hand identical to the winner.

19. The method of claim 18 wherein the order of turning said play cards and said discards face up may be any order as long as the sequence of play of turning over cards in said pyramid is followed, with said wild card turned face up after all of said play cards and all of said discards have been turned face up.

20. The method of claim 18 wherein said modified poker card game may be electronically adapted.

* * * * *